US005417414A

United States Patent [19]

Belec et al.

[11] Patent Number: 5,417,414

[45] Date of Patent: May 23, 1995

[54] STACKER IMPROVEMENT FOR HANDLING EXTERNAL SIDE SEAM ENVELOPES

[75] Inventors: Eric A. Belec, Southbury; William D. Toth, Milford, both of Conn.

[73] Assignee: Pitney Bowes Inc., Stamford, Conn.

[21] Appl. No.: 152,789

[22] Filed: Nov. 15, 1993

[51] Int. Cl.[6] ..... B65H 29/40

[52] U.S. Cl. ..... 271/178; 271/212

[58] Field of Search ..... 271/2, 177–179, 271/212

[56] References Cited

U.S. PATENT DOCUMENTS

| | | | |
|---|---|---|---|
| 3,606,312 | 9/1971 | Mens | 271/177 |
| 4,065,123 | 12/1977 | Arrasmith | 271/178 X |
| 4,116,430 | 9/1978 | Winchester | 271/177 |
| 4,640,505 | 2/1987 | Placke | 271/177 X |
| 4,718,660 | 1/1988 | Daboub | 271/177 |
| 4,778,062 | 10/1988 | Pavie | 209/546 |
| 4,863,037 | 9/1989 | Stevens | 209/3.1 |
| 4,991,914 | 2/1991 | Kerstein | 312/319 |
| 5,119,954 | 6/1992 | Svyatsky | 209/584 |
| 5,201,504 | 4/1993 | Fallos | 271/2 |
| 5,224,697 | 7/1993 | Darchis | 271/201 |
| 5,233,814 | 9/1993 | Bergerioux | 53/536 |
| 5,244,344 | 9/1993 | Doeberl et al. | 414/798.2 |
| 5,245,547 | 9/1993 | Ramsey | 364/478 |

*Primary Examiner*—David H. Bollinger

*Attorney, Agent, or Firm*—Charles R. Malandra, Jr.; Melvin J. Scolnick

[57] ABSTRACT

The present invention provides an improvement in a stacking device having an urge roller, an input guide, a spring loaded backup paddle and a registration wall. The improvement comprises a series of ramp-shaped fingers located between the urge roller and the registration wall. The ramp fingers guide the lead edge of an envelope in such a manner as to create a pocket between the surface of the envelope and the ramp fingers. The lead edge of the next envelope follows the ramp fingers and thus is not forced against the surface of the previous envelope. As a result the lead edge of the second envelope will not catch on the external side seam of the first envelope.

4 Claims, 4 Drawing Sheets

STACKER IMPROVEMENT FOR HANDLING EXTERNAL SIDE SEAM ENVELOPES

FIELD OF THE INVENTION

The invention disclosed herein relates generally to apparatus for stacking mailpieces, and more particularly to apparatus for on-edge stacking of mailpieces.

RELATED APPLICATIONS

The present application is related to copending U.S. applications Ser. Nos. 08/152,790 and 08/152,791, filed concurrently herewith, and assigned to the assignee of the present invention.

BACKGROUND OF THE INVENTION

Conventional "on-edge" mail stacking systems are usually composed of a transport followed by various forms of stacking mechanisms. Generally, multi-bin on-edge stacking systems include gating mechanisms which divert specific mailpieces into predetermined stacker bins. Such on-edge stacking systems are well known. The overwhelming majority of these systems stack mailpieces received in a vertical orientation on a horizontal surface.

Typically, in an on-edge stacking device envelopes are transported vertically along a dual belt transport system, deflected into a stacker bin by a deflector mechanism, and guided into the bin by conventional guide and urging components. The envelopes always stop against some sort of vertical registration surface. The integrity of the on-edge stacking is facilitated by a flat surface, commonly referred to as a paddle, that is orthogonal to the registration surface and is generally spring loaded to maintain a tight stacking of the envelopes against the guide component.

The conventional guides are generally flat surfaces that are made of low abrasive material so as not to interfere with the envelope being urged to the registration surface. Such conventional guides have proved to be suitable for guiding most envelope types. However, problems have been experienced when the on edge stacker is stacking envelopes having external side seams. Such problems are caused by the normal force applied to the stack by the paddle which maintains a tight stack against the guide between the urging component and the registration surface. The lead edge of an envelope being urged toward the registration surface has a tendency to get caught in the side seam of the previous envelope so urged, thus preventing the former envelope from ever reaching the registration surface. At a minimum, this results in an uneven stacking of the envelopes that requires special attention of an operator. Even worse than the uneven stacking is that a jam may occur in the stacking bin.

It is an object of the present invention to provide an improvement to the stacker that eliminates the aforementioned problems.

SUMMARY OF THE INVENTION

The present invention provides an improvement in a stacking device having an urge roller, an input guide, a spring loaded backup paddle and a registration wall. The improvement comprises a series of ramp-shaped fingers located between the urge roller and the registration wall. The ramp fingers guide the lead edge of an envelope in such a manner as to create a pocket between the surface of the envelope and the ramp fingers.

The lead edge of the next envelope follows the ramp fingers and thus is not forced against the surface of the previous envelope. As a result the lead edge of the second envelope will not catch on the external side seam of the first envelope.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
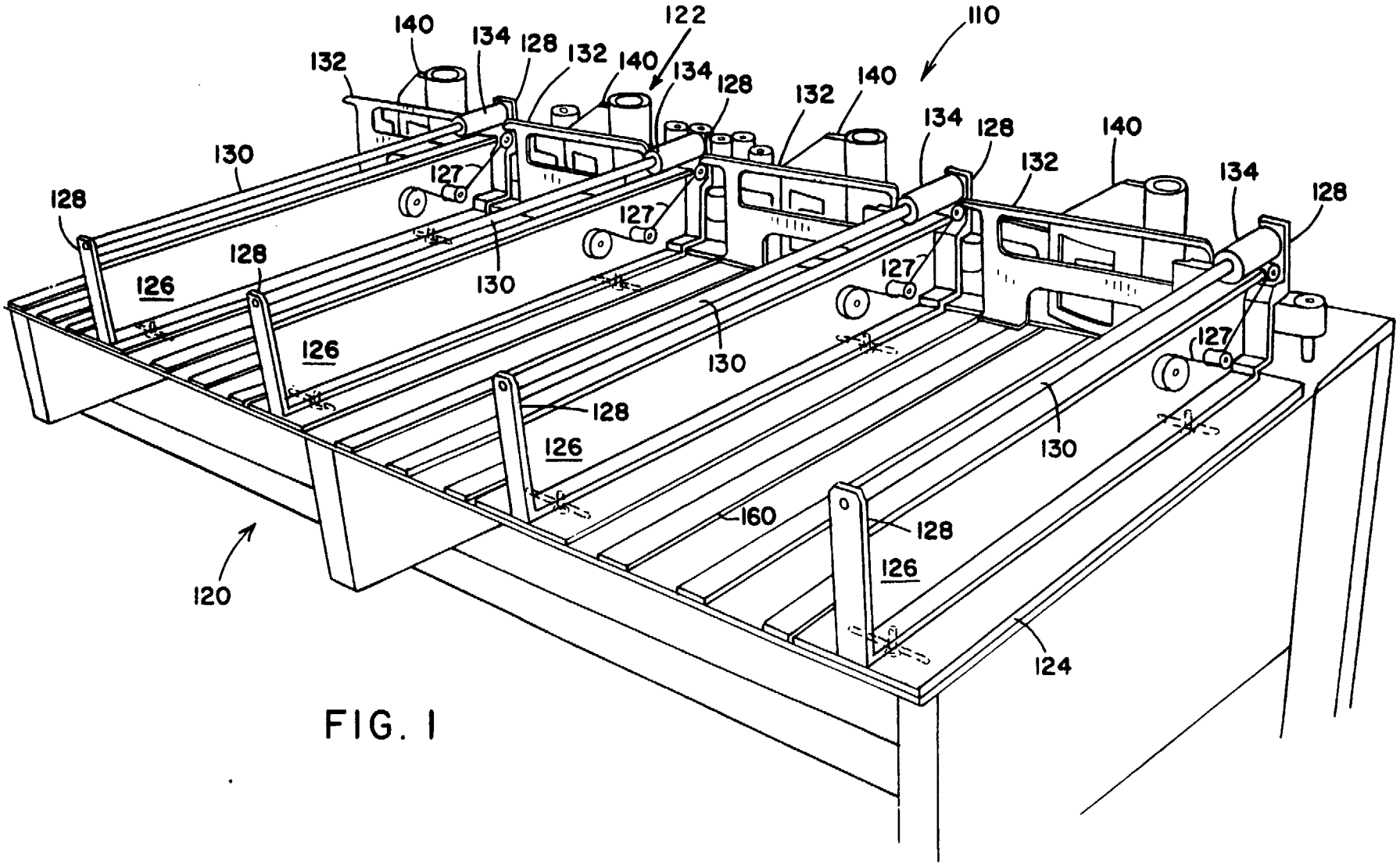
FIG. 1 is a perspective view of the stacking device in accordance with the present invention.
Figure 2:
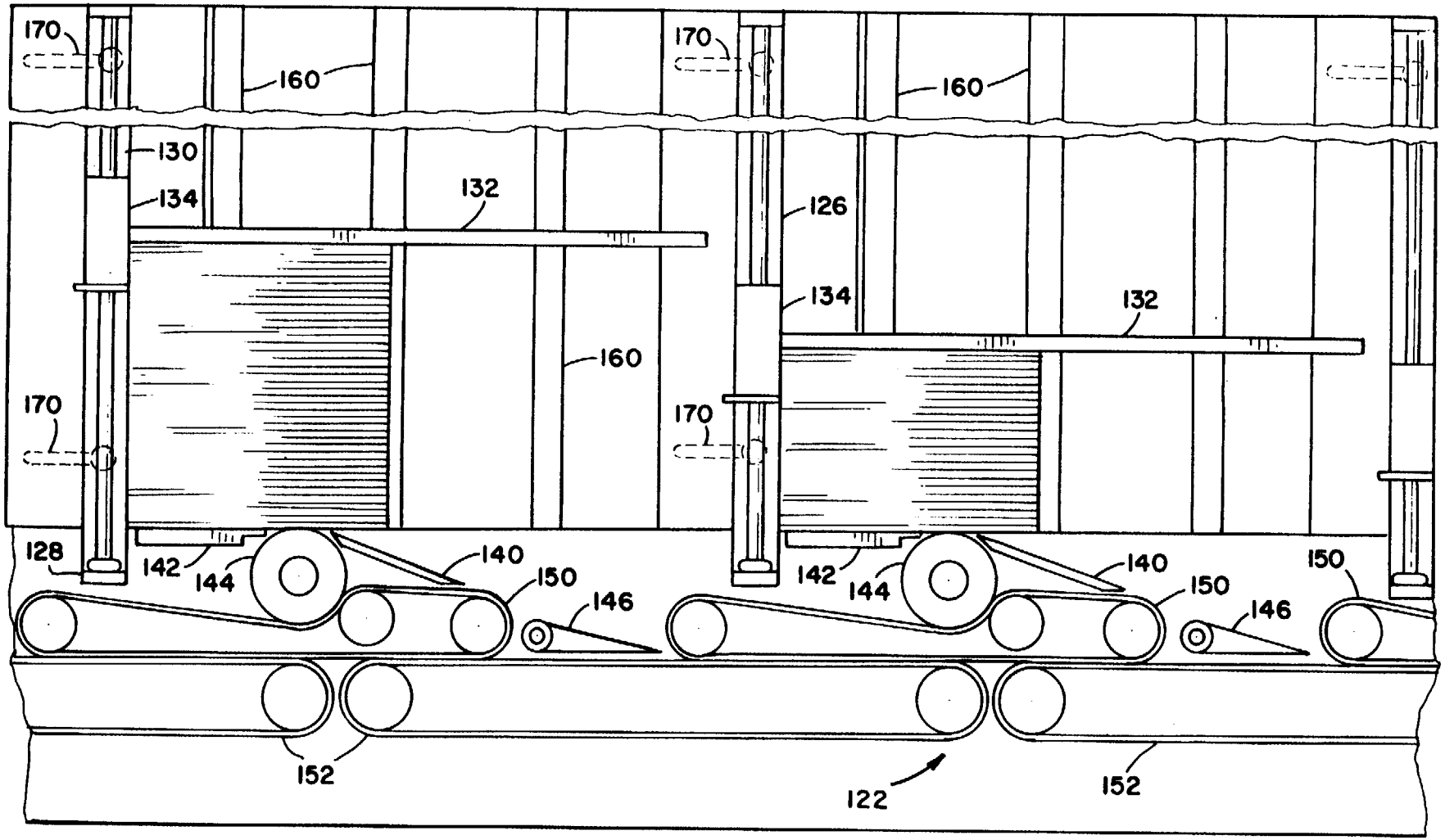
FIG. 2 is a top view of a stacking device with conventional guide means between an urge roller and a registration wall.

In describing the present invention, reference is made to the drawings, wherein there is seen in FIG. 1 a stacker 110 which includes a plurality of bins, generally designated 120, and a vertical transport, generally designated 122. Bins 120 include an base plate 124 and a plurality of registration walls 126 that are mounted to base plate 124. Registration walls 126 divide base plate 124 into separate bin sections. In the preferred embodiment of the present invention, four registration walls 126 are mounted at certain intervals along base plate 124 to make four separate bins. Each of registration walls 126 include a pair of end members 128 having a section thereof extending above the top of registration wall 126. Each registration wall 126 has a bar 130 that longitudinally extends above the top of the wall and is mounted to the pair of end members 128. A paddle 132 is slidably mounted on each of bars 130. Paddle 132 includes at one end a cylinder-shaped member 134 that is orthogonal to the flat section 136 of paddle 132. Cylinder member 134 includes an aperture through which Paddle 132 is slidably mounted on bar 130. In addition to moving up longitudinally along bar 130, paddle 132 can pivot (not shown) about bar 130 allowing the removal of a stack from the corresponding bin 120.

Paddle 132 is spring loaded on bar 130. The size of the spring 127 is critical in the present invention. A spring that is suitable for handling stacks of large envelopes that may weigh as much as 25 pounds, would provide too much resistance during the stacking of small envelope, the stack of which may be as little as 6 pounds. The converse is true for springs suitable for handling small stacks. In the preferred embodiment of the present invention, a nonlinear spring force from 8 ounces to 2 pounds can be used. For example, a commercially available spring reel can be used, such as ML-3949 manufactured by Ametek of Hatfield, Pa.

Each bin 120 further includes a lead-in guide plate 140 and a guide surface 142. An urge pulley 144 is sandwiched between guide plate 140, guide surface 142 and transport belt 150. Each bin 120 also has a gate 146 which is actuated by a destinations signal from a control system for stacker 110. Gate 146, when actuated, temporarily intersects transport 122 to thereby divert an envelope from the transport 122 into the bin 120.

Vertical transport system 122 is a dual belt system comprising a plurality of inner belt sections 150 and outer belt sections 152. Inner and outer belt sections 150 and 152 include conventional drive and idler pulleys around which endless elastic belts are stretched. Gates 146 are located between inner belt sections 150, adjacent to the inner reach of outer belt sections 152 and extend parallel to the transport path of vertical transport system 122. Gates 146 pivot at one end about a vertical axis. Each of gates 146 include a rectangular open section 145 in the non pivoting end through outer belt 152 travels when gate 146 pivots thereto. Outer belt section 152 is shown with multiple belts. In an alternate embodiment (not shown) a single outer belt transport is used in place of multiple outer belt sections 152. The single belt transport includes strategically placed idler pulleys which deflect the mail path to provide lateral force between the belts.

Low abrasive strips 160 are longitudinally fastened to the surface of base plate 124. As is described below, strips 160 must have a low coefficient of friction.

With the structure having been disclosed, the operation of stacker 110 is set forth. As the envelope is transported on edge by vertical transport system 122, the control system for the stacker causes a gate 146 of a bin 120 to deflect momentarily toward the adjacent outer belt. This causes the envelope to deflect off gate 146 and follow guide plate 140. The lead edge of the envelope hits the previously stacked envelope (or paddle 132 if the bin is empty) and urge roller 144 urges the envelope between guide surface 142 and the previously stacked envelope until the lead edge of the envelope hits registration wall 126. It can be seen that the most recently stacked envelope is flush against guide surface 142. It will be understood that when envelopes having external side seams are stacked in this manner there is a likelihood that the lead edge of an envelope being stacked will catch or stub the side seam of the previously stacked envelope.

Figure 3:
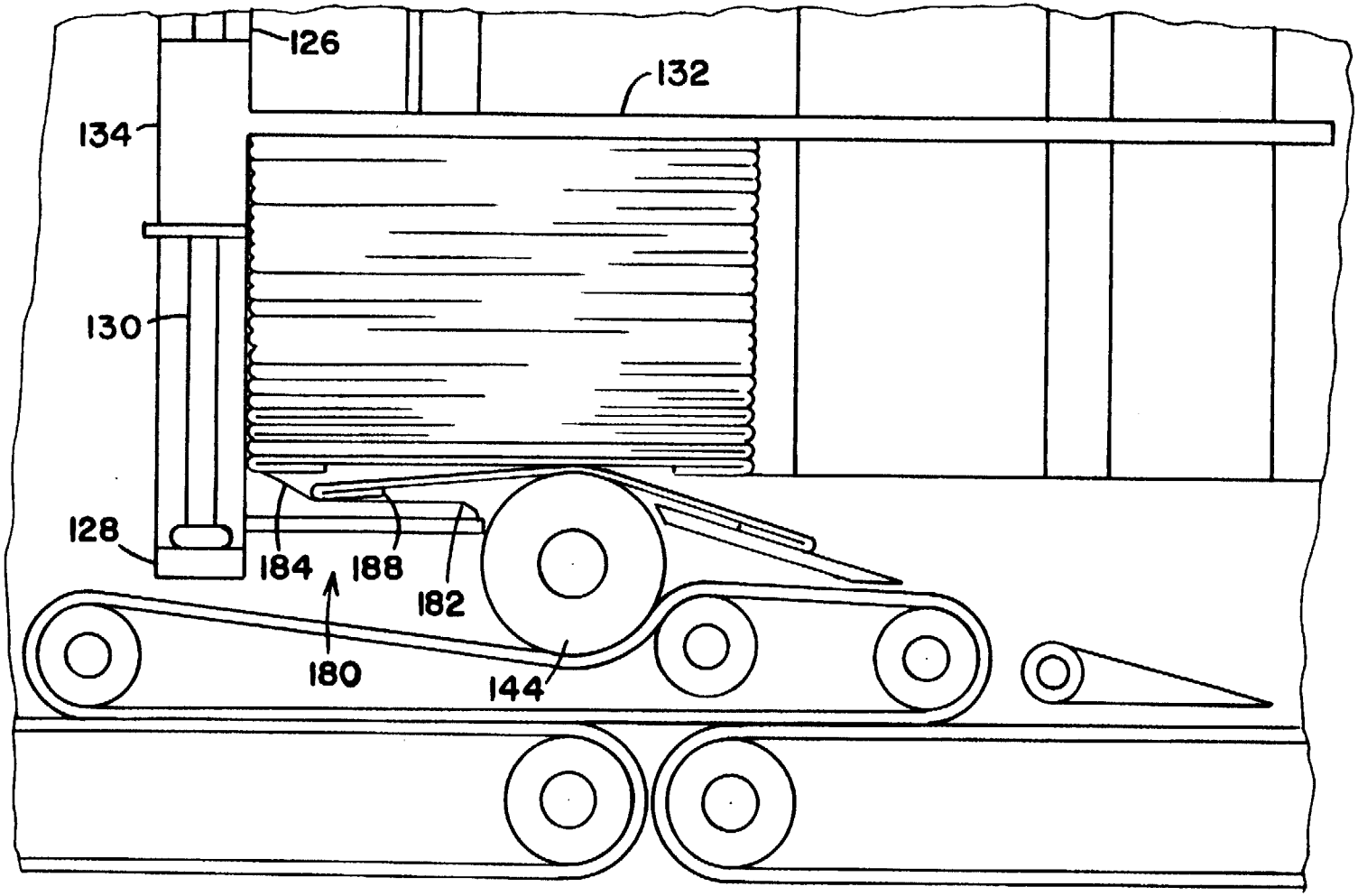
FIG. 3 is a top view of the stacking device of FIG. 1 with guide means in accordance with the present invention.
Figure 4:
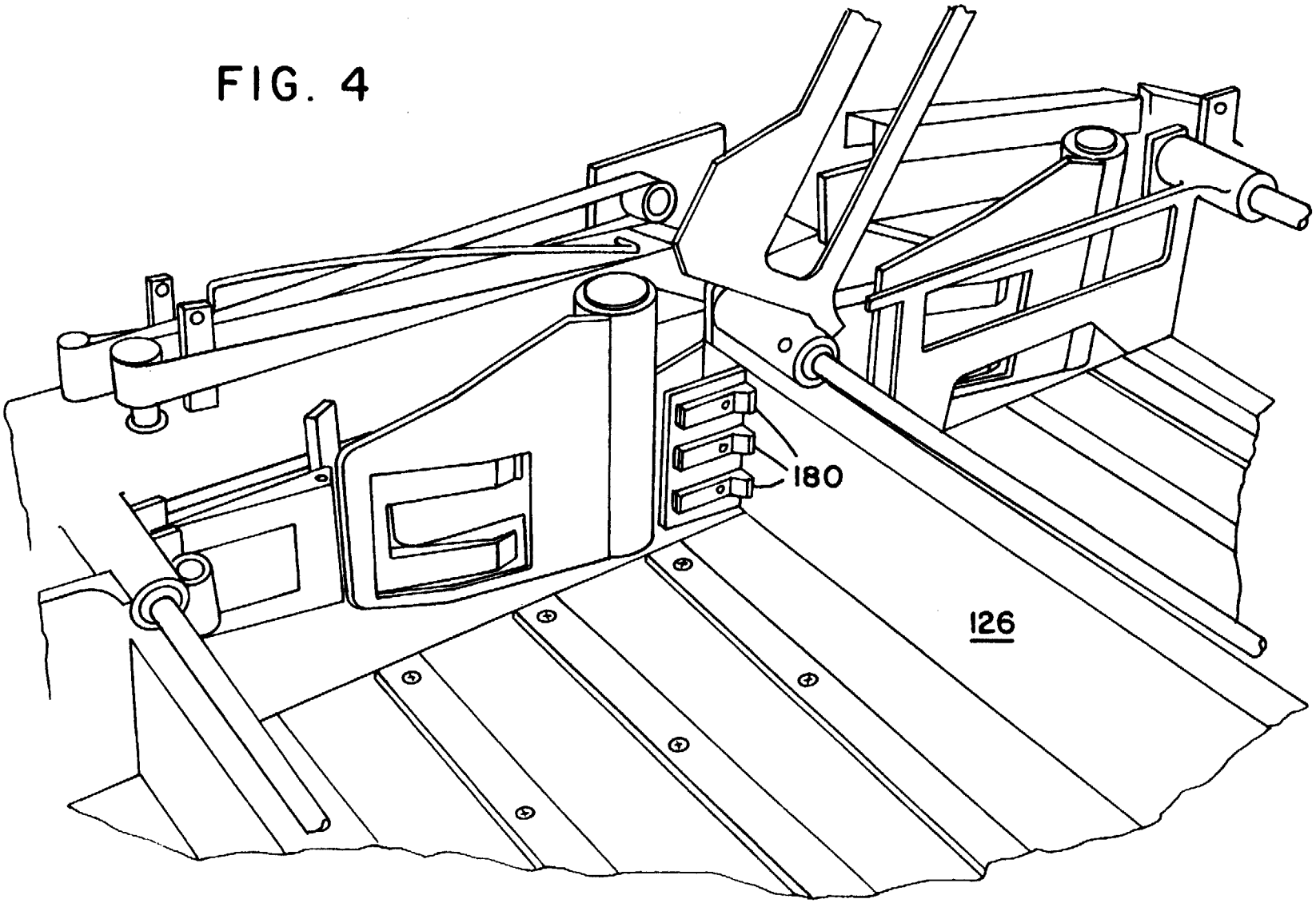
FIG. 4 is a perspective view of the stacking device of FIG. 3 showing the guide means in accordance with the present invention.

Referring now to FIGS. 3 and 4 the present invention provides a series of ramped shaped fingers 180 that are horizontally mounted to guide surface 142. Fingers 180 include a flat section 182 that extends toward urge roller 144, and a ramped section 184 that extends towards registration wall 126. Flat section 182 is recessed from the outer most surface of urge roller 144 so as to sufficiently expose urge roller 144 during the entire urging of the envelope to registration wall 126. In the preferred embodiment of the present invention, fingers 180 are made of Delrin AF, manufactured by DuPont of Wilmington, Del.

In accordance with the present invention, as each envelope approaches registration wall 126, the envelope bends slightly and the lead edge of the envelope follows the recessed flat section 182 on fingers 180. When the lead edge contacts ramped section 184, it follows ramped section 184 until it stops against registration wall 126. As shown in FIG. 3, once an envelope stops against registration wall 126, a pocket is formed between the envelope and the flat section 182. In this manner, the present invention avoids the stubbing of external side seams 188 of the envelopes.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. In an apparatus for stacking flat articles on edge comprising a deck plate, a vertical registration wall mounted on the deck plate, the vertical registration wall defining a stacking bin in which the flat articles are stacked, a deflector for deflecting the flat articles into the stacking bin, an urge roller located in the stacking bin between the deflector and the registration wall for urging the flat articles towards the registration wall, guide means situated between the urge roller and the registration wall for guiding the flat articles to the registration wall, and a paddle slidably positioned in the stacking bin orthogonal to the registration wall and above the deck surface, the paddle including a spring force toward the urge roller, wherein the paddle is adjacent the urge roller when the bin is empty and moves down the bin as flat articles are stacked against the registration wall, an improvement to the guide means comprising:

means for creating a pocket between the leading edge of the last flat article stacked in said stacking bin and the leading edge of an flat article being urged toward said registration wall.

2. The improvement of claim 1 wherein said pocket creating means comprises a plurality of vertically spaced fingers located between said urge roller and said registration wall, each of said fingers includes a profile of a flat, recessed section adjacent said urge roller and a ramped section adjacent said registration wall, whereby the leading edge of the flat article being urged toward said registration wall follows said profile of said fingers until the flat article stops against said registration wall.

3. In an apparatus for stacking envelopes on edge comprising a deck plate, a vertical registration wall mounted on the deck plate, the vertical registration wall defining a stacking bin in which the envelopes are stacked, a deflector for deflecting the envelopes into the stacking bin, an urge roller located in the stacking bin between the deflector and the registration wall for urging the envelopes towards the registration wall, guide means situated between the urge roller and the registration wall for guiding the envelopes to the registration wall, and a paddle slidably positioned in the stacking bin orthogonal to the registration wall and above the deck surface, the paddle including a spring force toward the urge roller, wherein the paddle is adjacent the urge roller when the bin is empty and moves down the bin as envelopes are stacked against the registration wall, an improvement to the guide means comprising:

means for creating a pocket between the leading edge of the last envelope stacked in said stacking bin and the leading edge of an envelope being urged toward said registration wall.

4. The improvement of claim 3 wherein said pocket creating means comprises a plurality of vertically spaced fingers located between said urge roller and said registration wall, each of said fingers includes a profile of a flat, recessed section adjacent said urge roller and a ramped section adjacent said registration wall, whereby the leading edge of the envelope being urged toward said registration wall follows said profile of said fingers until the envelope stops against said registration wall.

* * * * *